United States Patent [19]

Maroist

[11] 4,310,926

[45] Jan. 19, 1982

[54] FIREPROOF SUIT

[76] Inventor: Jules Maroist, 1760 boul. Hamel Ouest, Québec, Qué. G1N 3Z2, Canada

[21] Appl. No.: 72,834

[22] Filed: Sep. 6, 1979

[51] Int. Cl.[3] ..... A41D 11/00

[52] U.S. Cl. ..... 2/81

[58] Field of Search ..... 2/81, 2.1 A, 69, 69.5

[56] References Cited

U.S. PATENT DOCUMENTS

| | | | |
|---|---|---|---|
| 3,043,300 | 7/1962 | Flagg | 2/81 X |
| 3,348,236 | 10/1967 | Copeland | 2/81 X |
| 3,523,301 | 8/1970 | Davis et al. | 2/2.1 A |
| 3,763,497 | 10/1973 | Leach | 2/81 |

FOREIGN PATENT DOCUMENTS

| | | | |
|---|---|---|---|
| 1458357 | 12/1976 | United Kingdom | 2/81 |

*Primary Examiner*—Ronald Feldbaum

*Attorney, Agent, or Firm*—Schwartz, Jeffery, Schwaab, Mack, Blumenthal & Koch

[57] ABSTRACT

The invention relates to a suit enabling a person while wearing it to walk through high temperature flames and fire. The suit according to the invention comprises an inner impermeable flexible sheet material shaped to cover the entire body of a person, and at least one outer permeable flexible sheet material substantially shaped as the inner sheet material. The inner sheet material and the one or more outer sheet materials are combined together to form a multi-ply assembly adapted to be worn by this person. This multi-ply assembly therefore includes hood or bonnet, arms, trunk and leg portions. By means of an inlet, water is continuously introduced under pressure into the multi-ply assembly between the inner sheet material and the outer permeable sheet material(s). An outlet enables the water to continuously exit from between the inner sheet material and the outer permeable sheet material(s) after having circulated therebetween. Continuous vertical channels are provided between the inner sheet material and the outer sheet material(s), thus enabling the water to continuously circulate therethrough from the inlet to the outlet. Finally, there is a viewing window in the hood or bonnet portion and an opening in the multi-ply assembly to permit a person to put on the suit.

8 Claims, 5 Drawing Figures

FIREPROOF SUIT

BACKGROUND OF THE INVENTION (a) Field of the Invention

This invention relates to a fireproof suit. More particularly, the invention relates to a suit enabling a person wearing it to walk through high temperature flames and fire.

(b) Description of Prior Art

Fighting fires is a task which is extremely demanding. The most visible aspect of it is to spray water on a construction site or anything of value, thus trying to extinguish the fire in order to prevent a complete destruction of the site. However, this is just one part among others of fighting a fire. Sometimes, it is essential for a person to walk through a building or a construction site or the like which is partly or completely filled with smoke or flames.

Smoke alone produced by a fire in a building does not cause too many problems because extremely good suits and masks are now available which are more than adequate. However, in the presence of flames fire or extreme heat, a fire fighter usually wears an asbestos suit, but he always fears that a fellow worker might steam him to death accidentally, by spraying water on the heated suit. If, on the other hand, the flames are more important and substantial, such as in the case of an oil well which is on fire, and when one tries to put out this fire, there is not much to be done except to try to extinguish the fire when most of the oil has burned and heavy damages have been suffered. For example, in fighting oil well fires, the idea is to move through the flames and try to get at the valves to shut them off. Presently this is a worldwide problem for which, to my knowledge, there has not been found a truly good solution.

SUMMARY OF THE INVENTION

The invention relates to a suit enabling a person while wearing it to walk through high temperature flames and fire. The suit according to the invention comprises an inner impermeable flexible sheet material shaped to cover the entire body of a person, and at least one outer permeable flexible sheet material substantially shaped as the inner sheet material. The inner sheet material and the one or more outer sheet materials are combined together to form a multi-ply assembly adapted to be worn by this person. This multi-ply assembly therefore includes hood or bonnet, arms, trunk and leg portions. By means of an inlet, water is continuously introduced under pressure into the multi-ply assembly between the inner sheet material and the outer permeable sheet material(s). An outlet enables the water to continuously exit from between the inner sheet material and the outer permeable sheet material(s) after having circulated therebetween. Continuous vertical channels are provided between the inner sheet material and the outer sheet material(s), thus enabling the water to continuously circulate therethrough from the inlet to the outlet. Finally, there is a viewing window in the hood or bonnet portion and an opening in the multi-ply assembly to permit a person to put on the suit.

DESCRIPTION OF PREFERRED EMBODIMENTS

Figure 1:
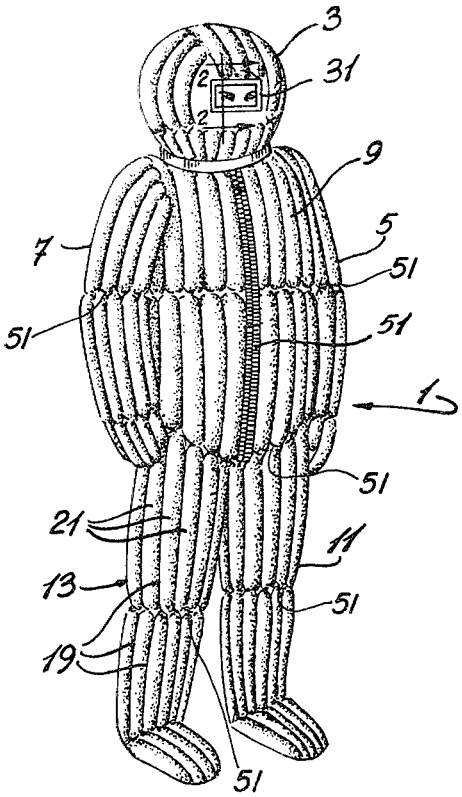
FIG. 1 is a perspective view of a suit according to the invention.
Figure 2:
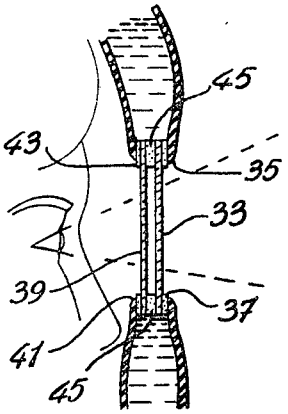
FIG. 2 is a cross section taken through the viewing window.
Figure 4:
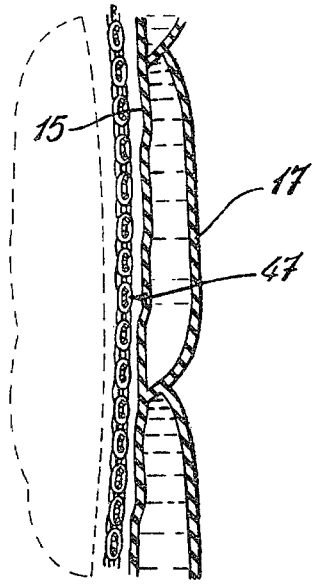
FIG. 4 is a partial view showing the inner lining of the suit mounted on the steel wire dummy.

Referring to the drawings, more particularly FIG. 1, the suit 1 according to the invention will appear as a kind of diving suit which, as usual, comprises, a hood or bonnet 3, arms 5 and 7, trunk 9 and leg portions 11 and 13. With particular reference to FIG. 4, it will be seen that the suit 1 according to the invention essentially comprises an inner impermeable flexible sheet material 15 which is shaped to cover the entire body of a person, and an outer permeable flexible sheet material 17 which is substantially shaped as the inner sheet material 15. Since the inner sheet material 15 must be impermeable as it will become obvious as the present description proceeds, it will preferably be made of a plastic material from which an impermeable sheet of material which is also flexible can easily be obtained. The choice of the particular plastic can vary to a large extent, such as a material commonly known as a Vinyl. Any person skilled in the art will easily select the most appropriate type of plastic material, or any other suitable material.

As to the outer permeable flexible sheet material 17, it preferably consists of heavy cotton for it is naturally permeable. However, any synthetic material which is not too flamable, such as polyester can also be used.

It has been mentioned above that the outer sheet material 17 should be shaped substantially as the inner sheet material. The idea behind this requirement is that when fabricating the suit 1 according to the invention, the inner sheet material 15 and the outer sheet material 17 will be combined together such as by sewing as shown at 19 in the drawings. Of course any other means of forming lines of attachment can also be used, although sewing is much preferred for convenience. Referring again to the drawings it will be seen that sewing at 19 is not only for the purpose of combining the inner and outer sheets 15,17 together, because the sewing operation must also be intended to produce continuous channels 21 between the inner sheet material 15 and the outer sheet material 17. As mentioned later on, this network of continuous channels will enable water which is introduced into the suit in a manner discussed more in detail hereinbelow, to circulate in a continuous fashion all through the inner space between the inner and outer sheets 15,17. Also as shown, sewing of the two sheets 15,17 together at 19 will cause the channels to adopt a generally tubular elongated shape when they are filled with water.

Figure 5:
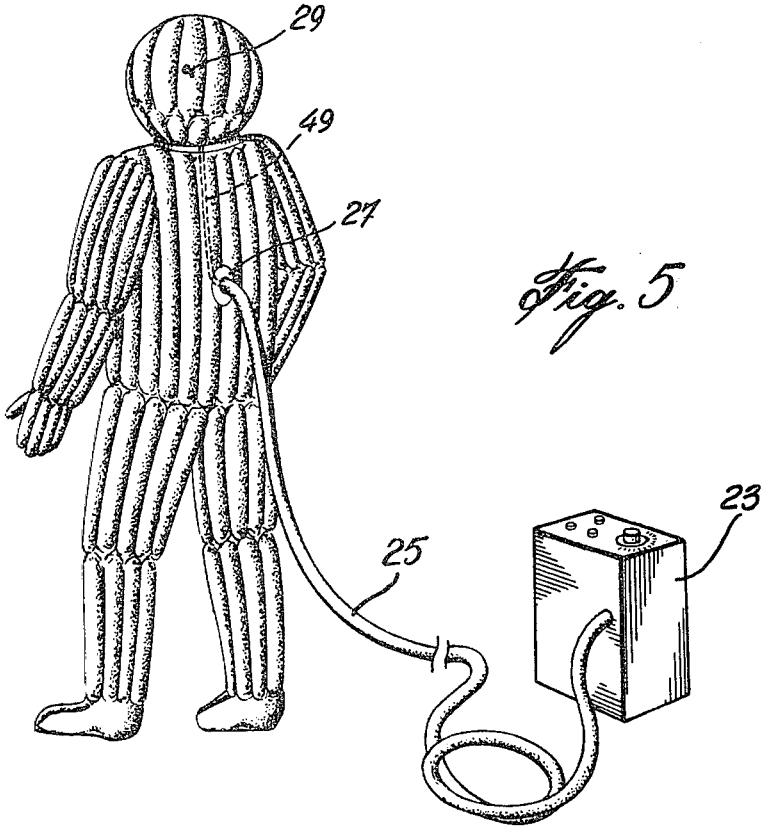
FIG. 5 is a perspective view from the back of a suit showing the pump and water duct.

As shown in FIG. 5, associated with the suit 1, there is a water pump 23 and a hose 25 which connects the water pump to an inlet 27 provided at the back of the suit 1. The pump 23 should be regulated to produce a continuous flow of water under constant pressure through the network of channels 21. This pressure is of course arbitrary, it being sufficient that it maintains the channels 21 filled with water which circulates continuously when the suit is in use. If the heat which is evolved from the fire is extremely high, it may be necessary to raise the pressure in order to ensure a faster flow of water.

As shown in the drawings, more particularly in FIG. 5, water which has circulated through the channels 21 exits from the suit through outlet 29 which is provided in the hood or bonnet portion 3 of the suit. Of course, the outlet 29 can be mounted anywhere else on the suit 1. However, in order to make sure that there is continuous circulation of water throughout the entire network of channels it is recommended to mount the outlet 29 as remote as possible from the inlet 27. In practice, it is preferable to provide the inlet 27 and the outlet 29, as shown, i.e., respectively at the back portion and the hood or bonnet portion 3 of the suit 1.

Figure 3:
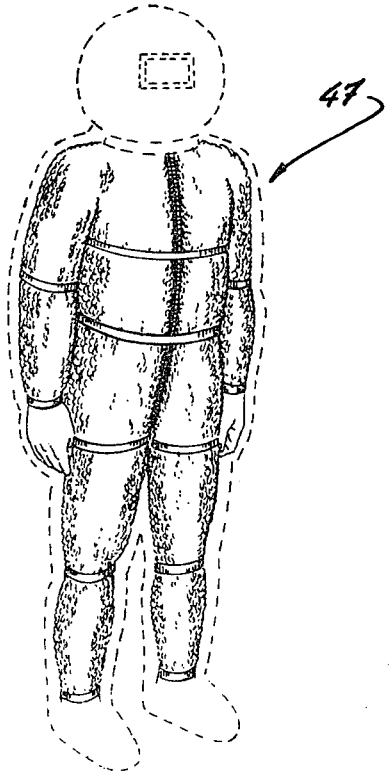
FIG. 3 is a perspective view of a steel wire dummy to to be used with a suit according to the invention.

In order to enable a person who is inside the suit 1 to see what is going on around and to permit manual operations while being surrounded by flames or smoke, there is provided a viewing window 31 in the hood or bonnet portion 3 of the suit. As shown in FIG. 3, the viewing window 31 comprises a rectangular glass panel 33 which is disposed in an opening 35 formed in the outer sheet material 17 and has its periphery glued as shown at 37 to the outer sheet around the opening 35. The viewing window 31 comprises a second rectangular glass panel 39 which is disposed in an opening 41 formed in the inner sheet material 15 and has its periphery glued as shown at 43 to the inner sheet material around the opening 41. Perforated spacers 45, made of cotton are disposed between the glass panels 33 and 39 along the upper and lower edges of both glass panels. This will enable a free circulation of water between the glass panels when the pump 23 is in operation.

Referring to FIG. 3, there is shown a steel wire dummy 47 which is worn by a person before putting on the suit according to the invention. This dummy 47 is highly recommended to prevent the water in the hose from exerting too much pressure against the body.

In order to enable the person inside the suit 1 to have enough air to breathe easily, the hose 25 has an inner tube 49 therein which is connected to a supply of air not shown and this inner tube 49 extends directly inside the suit 1 preferably inside the hood or bonnet portion 3 where it will be more suitable to supply air to the person inside the suit 1. Alternatively, although this does not constitute an essential characteristic of the invention, there may be provided a supply of air inside the suit 1, in the form of a reservoir which is well known to those skilled in the art.

In order to enable a person to put on the suit according to the invention it is necessary to provide a suitable opening in the form of a zipper 51 which has been provided in the front part of the suit 1, but which obviously can be placed anywhere else if it is found more convenient.

Finally, under special circumstances, it may be required to have a communication system with the outside. Such a system which is well known to those skilled in the art, can be mounted in any suitable manner inside the suit 1.

In the case of a fire where flames are important and if it is required to reach somebody or something in the middle of the flames, one puts on the dummy 47, followed by the suit 1. The water pump 23 and the hose 25 are connected to the suit 1 and water is allowed to continuously flow through the channels 21. Once the continuous flow is established a person can walk through fire without running the risk of suffering burns because water serves as a barrier against the fire and the heat that they produce. Permeation of water through the outer sheet 17 produces a secondary barrier which further helps in preventing the water circulating in the channels from becoming too warm.

To ensure that water pressure will build up within the suit, thereby forcing water out through the permeable outer sheet material 17, the tubular channels 21 are formed vertically on the suit. These channels are included primarily to provide flexibility to the suit to facilitate a person's movement while wearing the suit. To further increase mobility, the channels are substantially reduced in cross section opposite main body articulations to form joints 51 shown in FIG. 1. Joints 51 include elbow joints, knee joints and hip joints which aid the person in flexing these body portions. Typically, joints 51 are formed at each main body articulation.

I claim:

1. A suit enabling a person while wearing same to walk through high temperature flames and fire, which comprises:

an inner water-impermeable, flexible sheet material shaped to cover the entire body of a person, at least one outer water-permeable, flexible sheet material substantially shaped as said inner sheet material, means to combine said inner sheet material and said at least one outer sheet material to form a multi-ply assembly adapted to be worn by said person and including hood or bonnet, arms, trunk and leg portions, said assembly having means including an inlet to continuously introduce water under pressure into said multi-ply assembly between said inner water-impermeable, flexible sheet material and said at least one outer water-permeable sheet material, and means including an outlet to enable said water to continuously exit from between said inner water-impermeable, flexible sheet material and said at least one outer water-impermeable sheet material after having circulated therebetween, said inner water-impermeable, flexible sheet material and said outer water-permeable, flexible sheet material being longitudinally sewn together so as to form continuous vertical tubular channels covering the entire surface of said multi-ply assembly, so as to enable said water to continuously circulate therethrough from said inlet to said outlet, said tubular channels being substantially reduced in cross section opposite main body articulations to form joints;

a viewing window formed in said hood or bonnet portion, and an opening in said assembly to permit said person to put on said suit.

2. A suit according to claim 1, which comprises means to be worn by said person underneath said multi-ply assembly to prevent said multi-ply assembly from pressing against the body of said person when water is circulated through said channels.

3. A suit according to claim 1, which comprises a water pump and a hose between said pump and said inlet, said pump being adapted to feed water under constant pressure into said multi-ply assembly, through said channels.

4. A suit according to claim 1, wherein said water inlet is provided at the back of said multi-ply assembly, and the water outlet is provided in the upper and lower portion thereof.

5. A suit according to claim 1, wherein said viewing window comprises a first rectangular glass panel disposed in a first opening formed in said outer sheet material and having its periphery glued to said outer sheet material around said first opening, and a second rectangular glass panel disposed in a second opening formed in said inner sheet material and having its periphery glued to said inner sheet material around said second opening, and perforated spacers made of cotton disposed between said first and second glass panels along the upper and lower edges thereof, to enable free circulation of water between said glass panels when said pump is in operation.

6. A suit according to claim 1, which comprises a zipper to open and close said opening.

7. A suit according to claim 1, comprising a steel wire dummy to be worn by said person under said suit to prevent excess pressure on the body.

8. A suit according to claim 1, which comprises a supply of air and a duct between said supply of air and the inside of said suit, said duct running inside said means to introduce water into said assembly.

* * * * *